United States Patent [19]

Cohen

[11] 4,240,240

[45] Dec. 23, 1980

[54] METHOD OF MAKING A PACKAGE HAVING FOAM INSERTS

[75] Inventor: Joel B. Cohen, Wynnewood, Pa.

[73] Assignee: Shell Container Systems, Springfield, N.J.

[21] Appl. No.: 57,910

[22] Filed: Jul. 16, 1979

[51] Int. Cl.[3] ..... B65B 43/00

[52] U.S. Cl. ..... 53/410; 53/472

[58] Field of Search ..... 53/472, 410, 452, 411, 53/453, 474, 449

[56] References Cited

U.S. PATENT DOCUMENTS

| | | | |
|---|---|---|---|
| 2,282,908 | 5/1942 | Thompson | 53/472 X |
| 2,897,641 | 8/1959 | Simon et al. | 53/472 X |
| 3,204,385 | 9/1965 | Remer et al. | 53/472 X |
| 3,222,843 | 12/1965 | Schneider | 53/472 X |
| 3,420,363 | 1/1969 | Blickensderfer | 53/472 X |
| 4,030,267 | 6/1977 | Arnaud | 53/472 X |

*Primary Examiner*—Horace M. Culver

*Attorney, Agent, or Firm*—Lerner, David, Littenberg & Samuel

[57] ABSTRACT

A method is provided for making a package having upper and lower foam cushion inserts which cooperate with each other to enclose an article therebetween which is placed in the package. The method includes the steps of forming convolutions in at least one surface of a piece of foam material to form a first foam insert, and then removing a section of convoluted foam material from the piece of foam material to form a cutout therein. Then, the removed section which forms the second foam insert is applied to one wall of a package with the unconvoluted surface thereof adhered to the wall, and the first foam insert is applied to an opposite wall of the package, with the second insert being in alignment with the cutout area of the first insert, whereby an article placed in the cutout area is cushioned between the foam material on the opposite walls of the package.

11 Claims, 6 Drawing Figures

METHOD OF MAKING A PACKAGE HAVING FOAM INSERTS

FIELD OF THE INVENTION

The present invention relates generally to package-making, and specifically to packages which include cooperating foam cushion inserts for cushioning an article therebetween.

BACKGROUND OF THE INVENTION

In recent years, it has been common practice to include foam cushions in a package in order to cushion and protect delicate articles contained in the package during handling and shipping. In one typical arrangement, two pieces of flat foam material are employed to make the two cushion inserts for one package. In this method, at least one of the two flat foam pieces for the package is contour cut, so that a section is removed from the flat foam to form a cutout area which is shaped so as to match the shape of the article to be placed therein. The cutout section is discarded and is not used in the package. Then, the contour cut piece of foam material is placed on one wall of the package, and another piece of flat foam material is placed on an opposite wall of the package. The article to be packaged is placed in the cutout area of the foam material, and when the package is closed, the article is cushioned between the two pieces of foam material.

Although the foregoing process produces a satisfactory product, the process is uneconomical and wasteful, since two separate pieces of flat foam material are required to form the cushion inserts for one package. In addition, it is also wasteful to discard and not use the section cutout of the foam material. For these reasons, such a process has not been completely satisfactory.

Broadly, it is an object of the present invention to provide an improved method which overcomes the aforesaid problems. Specifically, it is within the contemplation of the present invention to provide an improved method which only requires one piece of foam material to form the two cushion inserts for each package by utilizing the section removed from the piece of foam material as one of the foam cushion inserts.

It is a further object of the present invention to form the two convoluted cushion inserts for a package from a single piece of foam material to provide a highly economical and efficient manner of making such packages.

SUMMARY OF THE INVENTION

Briefly, in accordance with the principles of the present invention, an improved method is provided for making a package having first and second foam cushion inserts, wherein the method includes the steps of forming convolutions in at least one surface of a piece of foam material so as to form a first foam insert which is adapted to fit in a package. Then, a section of convoluted foam material is removed from the first foam insert to form a cutout area in the first foam insert for receiving an article, and the removed section of foam material forms a second foam insert. The first and second foam inserts are then inserted into a package, with the cutout area facing the second foam insert so that the cutout area is adapted to receive an article to be packaged. In addition, the second foam insert is placed in the package, such that it is disposed opposite to and in alignment with the cutout area of the first foam insert. In this manner, an article placed in the cutout area is cushioned between the first and second foam inserts when the package is closed.

Advantageously, as a result of the present invention, the two foam cushion inserts for a package may be formed from a single piece of foam material by utilizing the removed section as the second foam insert. This avoids the wasteful prior art process, wherein the cutout portion is discarded and not used in the package. In addition, the present invention recognizes that the contour cutting process, which had been used in the past only with respect to flat pieces of foam material, can be adapted to contour cutting of pieces of convoluted foam material.

BRIEF DESCRIPTION OF THE DRAWINGS

Further objects, features, and advantages of the present invention will become apparent upon the consideration of the following detailed description of a presently preferred embodiment when taken in conjunction with the accompanying drawings, wherein.

DETAILED DISCUSSION OF PREFERRED EMBODIMENT OF THE INVENTION

Figure 6:
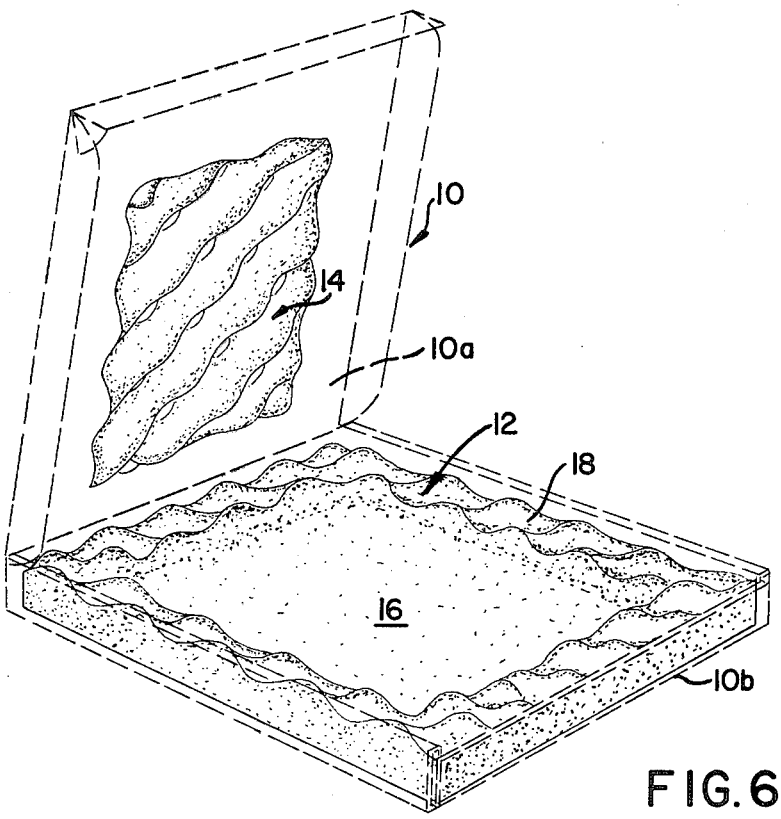
FIG. 6 is a perspective view of a package with the two foam cushion inserts included therein.

Referring first briefly to FIG. 6, there is shown an example of a package 10 including a first foam insert 12 and a second foam insert 14, which have been formed in accordance with the method of the present invention. As will be noted, foam insert 12 includes an upper surface having a cutout area 16 formed therein and a surrounding convoluted surface 18. In addition, as will be explained herein, foam insert 14 is formed by removing it from the cutout area 16 of foam insert 12 and inserting it into the package 10.

Referring now to FIGS. 1 to 4, a description is provided of how the foam inserts 12, 14 are formed so as to produce the package 10 in accordance with the present invention. More particularly, referring specifically to FIG. 1, there is shown a pair of rollers 20, 22 having male members 24, 26 formed thereon. In addition, a cutting blade 28 or other suitable cutting mechanism is positioned between the rollers 20, 22. In operation, a continuous piece of foam material 30 having flat surfaces 32, 34 is fed between the rollers 20, 22 so that the male members 24, 26 on the rollers produce convoluted foam surfaces 36, 38. Simultaneously, cutting blade 28 operates to cut the foam material 30 down its center to produce two pieces of convoluted foam material 40, 42, each having the convoluted surfaces 36, 38, respectively. As the method of forming convoluted foam material is well known in the prior art, this method is for the purpose of illustration only, and it should be understood that the convoluted foam pieces 40, 42 can be formed in any suitable manner.

Figure 1:
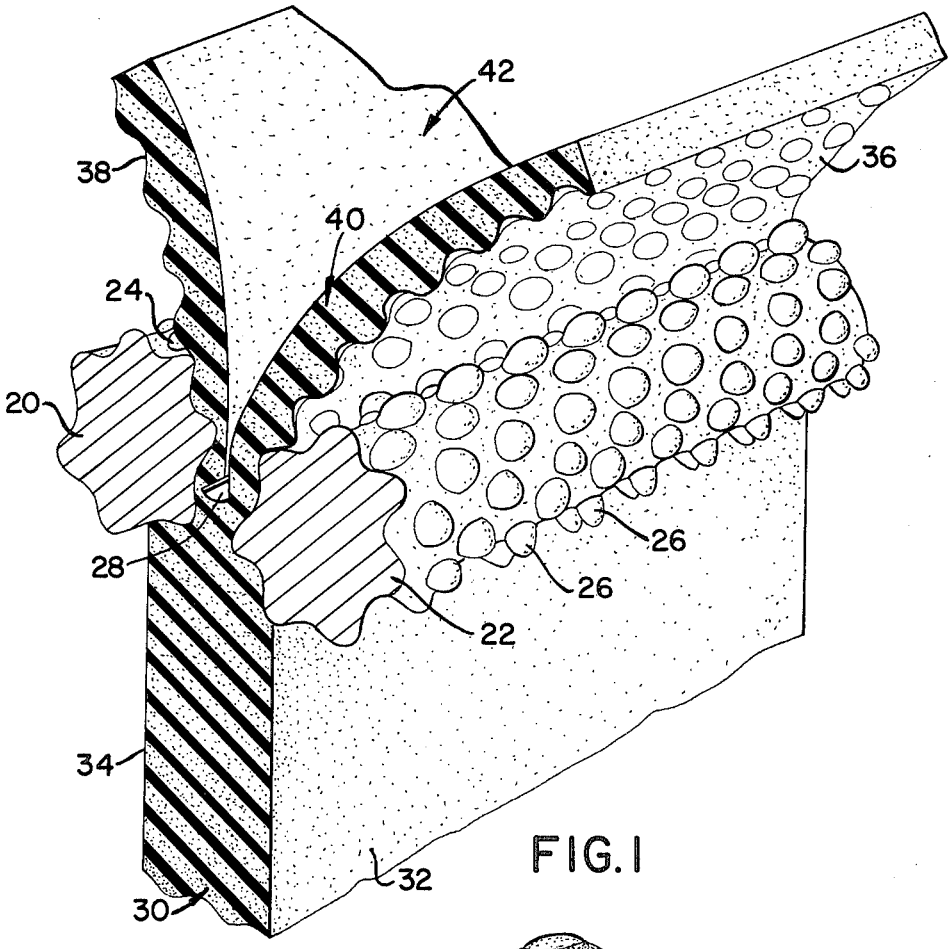
FIG. 1 is a perspective view illustrating the method of making convoluted foam material from a piece of flat foam material.
Figure 2:
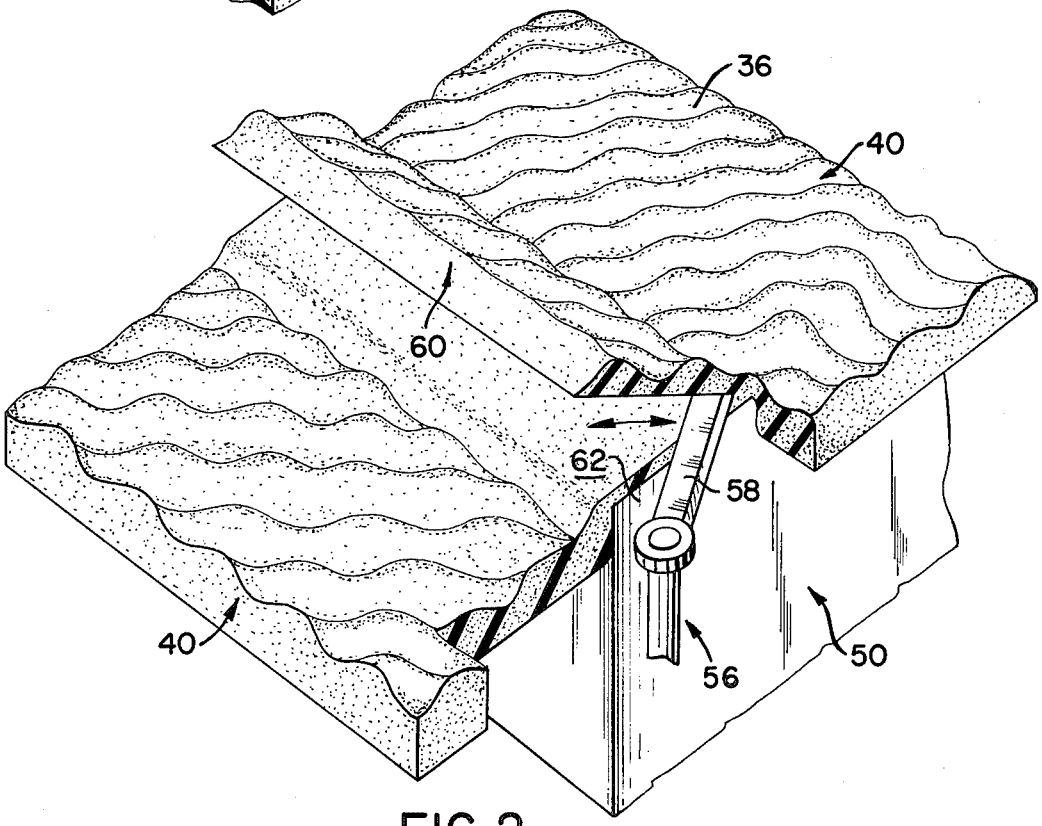
FIG. 2 is a perspective view illustrating the manner in which a convoluted piece of foam material is contour cut to remove a section thereof to form a cushion insert.
Figure 3:
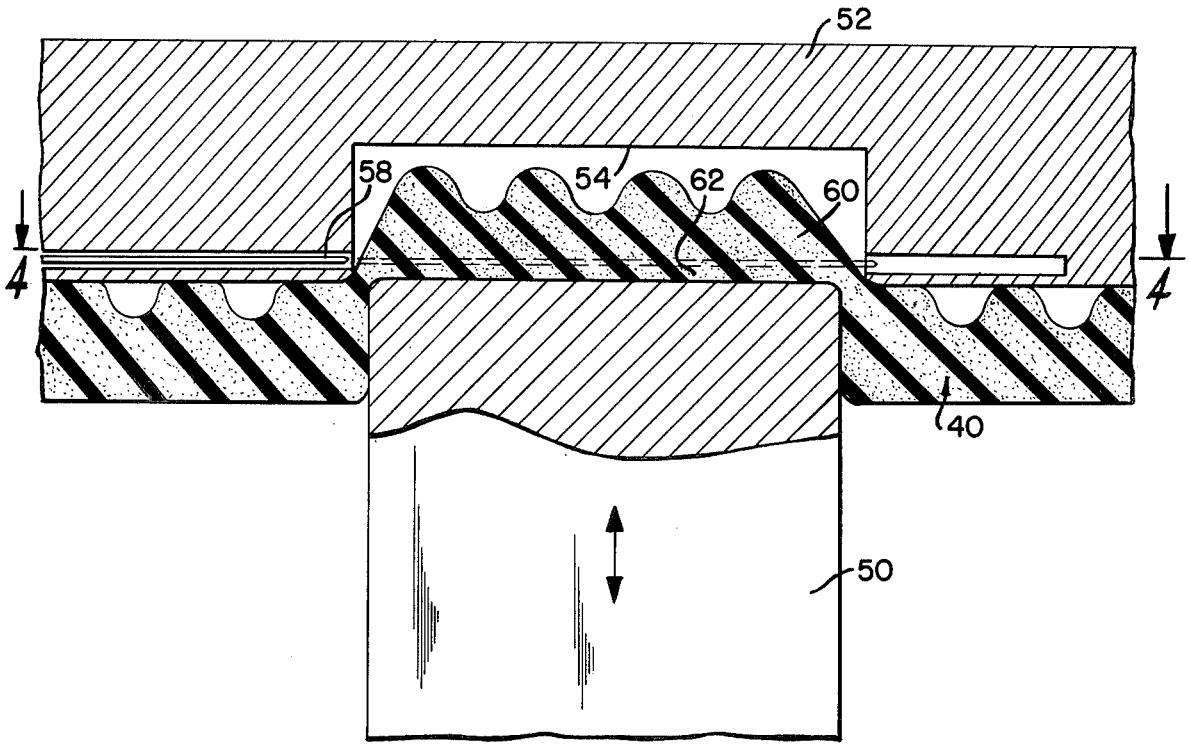
FIG. 3 is a sectional view of the process illustrated in FIG. 2.
Figure 4:
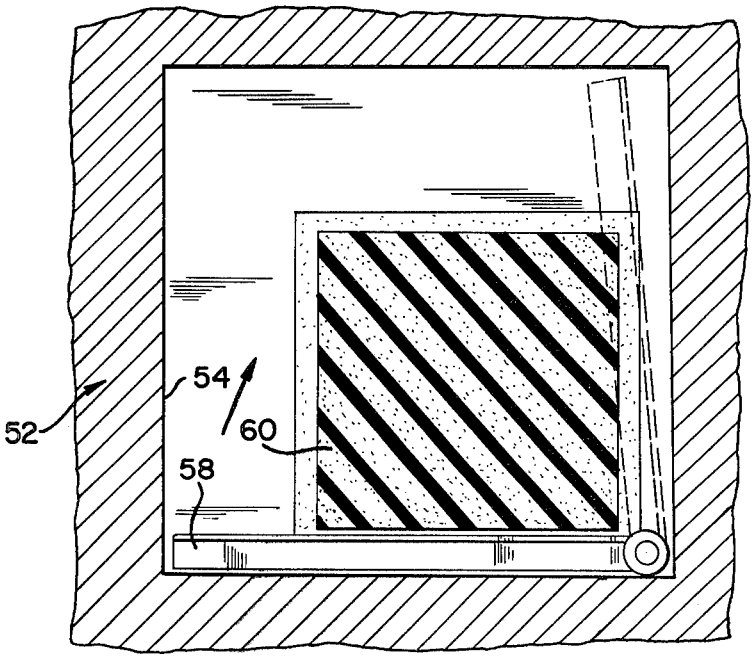
FIG. 4 is a sectional view taken on the line 4—4 of FIG. 3, illustrating the manner in which the convoluted foam is contour cut.

Referring to FIGS. 2, 3, and 4, the manner in which the convoluted foam pieces 40, 42 are contour cut will be explained. Although FIG. 2 illustrates the contour cutting of foam material 40, it should be understood that the same operations are to be applied to foam material 42. As shown in FIGS. 2 to 4, a movable block 50 forms the lower part of the die, and an upper block 52 forms the upper part of the die. As will be noted, upper member 52 is provided with a cutout area 54 so as to receive the foam material between members 50, 52. The apparatus also includes a suitable cutting mechanism 56 which is driven by a motor to operate the cutting blade 58 which is used in the contour cutting operation.

As will be understood, reciprocating member 50 moves upwardly to force a portion 60 of the convoluted foam material 40 into the cutout area 54 of upper member 52. The cutting blade 58 is positioned slightly above the upper surface of member 50 to leave a portion 62 as part of foam material 40, which portion 62 becomes the bottom of the cutout area in foam material 40. Cutting blade 58 is operated to remove foam portion 60 from foam material 40, leaving portion 62 as part of foam piece 40.

Figure 5:
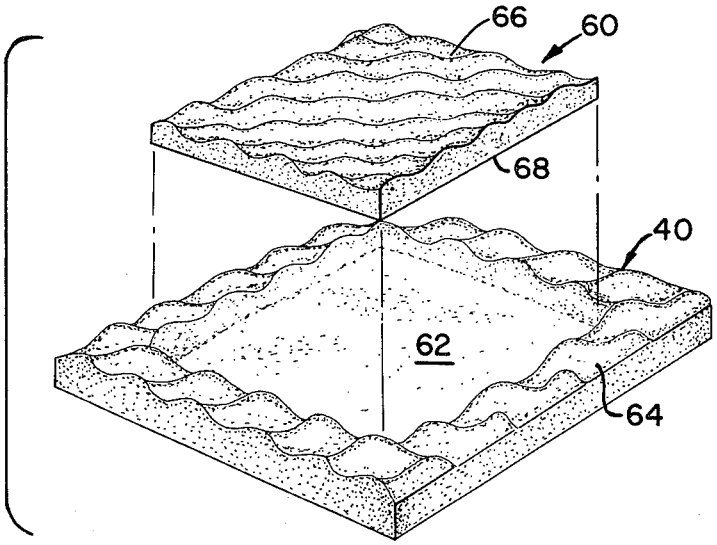
FIG. 5 is a perspective view illustrating the two foam cushion inserts formed from the single piece of convoluted foam material.

As shown in FIG. 5, the portion 60 is removed from foam piece 40 and thereby forms cutout area 62 surrounded by the convoluted foam surface 64. The removed foam section 60 has an upper convoluted surface 66 which was part of the surface 64 before it was removed, and removed section 60 also has a lower flat surface 68.

Referring now to FIGS. 5 and 6, it will be understood that removed foam portion 60 forms foam insert 14 which is applied to one wall 10*a* of package 10, with the flat surface 68 being adhered to the package wall 10*a*, in any suitable manner. In addition, foam material 40, shown in FIG. 5, is inserted in package 10, and its lower flat surface may or may not be adhered to the package wall 10*b* and becomes foam insert 12. As will be noted, foam insert 14 is attached to wall 10*a*, such that it is disposed directly opposite to and is aligned with cutout area 16, so that when the package 10 is closed, insert 14 is received within the cutout area 16. When an article is placed within cutout area 16, foam insert 14 may not enter the cutout area 16 completely but will cooperate with it to cushion the article between the foam inserts 12, 14 when the package is closed.

As will be understood, although foam insert 12 has been illustrated as being rectangular in shape, and although cutout area 16 and removed foam insert 14 have also been illustrated as being rectangular in shape, it is within the concept of the present invention to use any desired shape. For example, foam insert 12 may be circular, elliptical, or any other shape to match the configuration of the package 10. In addition, cutout area 16 can be cut to any desired shape, depending on the shape of the article to be packaged. For example, cutout area 16, and of course foam insert 14 formed therefrom, can be circular, elliptical, or match the configuration of the article being packaged. This includes irregular-shaped articles and the like, such as cathode ray tubes, wine glasses, etc.

Advantageously, as a result of the present invention, two foam inserts for a package are formed from the same piece of convoluted foam material. Therefore, the present invention provides a highly-economical and efficient method of making such convoluted foam inserts for packages.

A latitude of modification, change, and substitution is intended in the foregoing disclosure, and in some instances, some features of the invention will be employed without a corresponding use of other features. Accordingly, it is appropriate that the appended claims be construed broadly and in a manner consistent with the spirit and scope of the invention herein.

What is claimed is:

1. A method of making a package having first and second foam cushion inserts, comprising the steps of:

providing a package having relatively movable first and second sections, said first and second sections being movable towards and away from a closed position;

forming convolutions in at least one surface of a piece of foam material;

removing a section of foam material from said piece of foam material to form a cutout area in said piece of foam material for receiving an article, said piece of foam material with said cutout area therein defining a first foam insert and said removed section of foam material defining a second foam insert; and applying said first and second foam inserts to said first and second sections of said package, respectively, so that said cutout area faces said second foam insert and is in alignment therewith when said first and second sections are in said closed position, whereby an article placed in said cutout area is cushioned between said first and second foam inserts when said first and second sections of said package are in said closed position.

2. The method of claim 1, wherein the step of removing includes removing a section of foam material from a surface of said foam material having convolutions formed therein so that one surface of said removed section is convoluted.

3. The method of claim 1, wherein the step of applying comprises adhering one surface of said second foam insert to said second section of said package so that it is in alignment with said cutout area of said first foam insert.

4. The method of claim 1, wherein the step of applying comprises adhering an unconvoluted surface of said first foam insert to said first section of said package.

5. The method of claim 1, wherein the step of removing comprises deforming said piece of foam material so that a portion thereof is moved out of the plane of said piece of foam material, and then cutting said deformed portion to remove it from said piece of foam material.

6. The method of claim 1, wherein the step of removing comprises the step of cutting said piece of foam material so that the cut surface of said second foam insert matches the shape of the cutout area of said first foam insert.

7. The method of claim 1, wherein the first and second sections of said package include first and second walls, respectively, and said step of applying comprises adhering said first foam insert to said first wall and adhering said second foam insert to said second wall.

8. A method of making a package having first and second foam cushion inserts, comprising the steps of:

providing a package having relatively movable first and second sections, said first and second sections being movable towards and away from a closed position;

providing a piece of foam material;

removing a section of foam material from said piece of foam insert to form a cutout area therein for receiving an article, said piece of foam material with said cutout area therein defining a first foam insert and said removed section defining a second foam insert; and applying said first and second foam inserts to said first and second sections of said package, respectively, so that said cutout area of said first foam insert faces said second foam insert and is in alignment therewith when said first and second sections are in said closed position, whereby an article placed in said cutout area is cushioned between said first and second foam inserts when the first and second sections of said package are in said closed position.

9. The method of claim 8, further including the step of forming convolutions in at least one surface of said piece of foam material.

10. The method of claim 8, wherein the step of removing comprises deforming said piece of foam material so that a portion thereof is moved out of the plane of said piece of foam material, and then cutting said deformed portion to remove it from said piece of foam material.

11. The method of claim 8, wherein the step of removing comprises the step of cutting said piece of foam material so that the cut surface of said second foam insert matches the shape of the cutout area of said first foam insert.

* * * * *